United States Patent [19]

Lempio

[11] Patent Number: 4,669,726

[45] Date of Patent: Jun. 2, 1987

[54] GOLF CLUB

[76] Inventor: Paul S. Lempio, 11 Fay Dr., Kentfield, Calif. 94904

[21] Appl. No.: 776,427

[22] Filed: Sep. 16, 1985

[51] Int. Cl.[4] ..... A63B 53/16

[52] U.S. Cl. ..... 273/81.2; 273/165

[58] Field of Search ..... 273/81.2, 80.1, 165, 273/81 R, 81 D, 73 J, 75

[56] References Cited

U.S. PATENT DOCUMENTS

| | | | |
|---|---|---|---|
| 1,020,018 | 3/1912 | Bonin | 273/81.2 |
| 3,087,728 | 4/1963 | Pond | 273/80.1 X |
| 4,231,574 | 11/1980 | Williams | 273/81.2 |

*Primary Examiner*—George J. Marlo

*Attorney, Agent, or Firm*—Phillips, Moore, Lempio & Finley

[57] ABSTRACT

An extender is fixedly attached to the grip end of a golf club shaft to provide a shaft having a first predetermined length. The extender includes a plug inserted into the end of the shaft in co-axial alignment therewith and a grip portion secured on the plug to form an extension of the grip portion secured on the shaft. A similarly constructed second extender is adapted to replace the first extender to selectively change the length of the golf club shaft, e.g., from standard to oversized.

6 Claims, 3 Drawing Figures

GOLF CLUB

TECHNICAL FIELD

This invention relates generally to a golf club and more particularly to a device and method for selectively changing the fixed length of the shaft of the golf club.

BACKGROUND ART

It is common practice in the golf arts to secure a wooden dowel plug in the grip end of a golf club shaft, particularly a driver, when it is desired to increase the length of the shaft to "oversize." A new grip is used to replace the old grip when an extension plug of this type is utilized. Thus, when a golfer desires to periodically change back to a standard sized shaft, he must either remove the old grip and plug and secure a new grip on the shaft, or purchase a new golf club for this purpose. Further, it has been applicant's experience that the transport of his golf clubs on an airline will subject an oversized golf club shaft to damage or breakage.

Thus, it would prove highly desireable to provide the shaft of a single golf club with means for selectivelv changing the fixed length of its shaft without substantially changing the swinging characteristics of the club or violating the "Rules of Golf," as approved by the United States Golf Association and the Royal and Ancient Golf Club of St. Andrew's, Scotland.

DISCLOSURE OF INVENTION

This invention overcomes the above, briefly described prior art problems by providing a means and method for changing the fixed length of the shaft of a golf club expedtiously and economically without violating the rules of golf.

A golf club shaft extender of this invention comprises plug means for insertion into an end of a tubular golf shaft and grip means secured on the plug means for forming a continuation of a grip secured on the golf shaft.

In the preferred embodiment of this invention. a pair of extenders are provided in kit-form whereby the fixed length of the golf shaft can be selectively changed on a practice tee or for any particular round of golf. Rule 4-2 of the "Rules of Golf" preclude changing the playing characteristics of a club during a stipulated round of golf. However, one of the extenders could be used for playing a particular round of golf without departing from such rule.

BRIEF DESCRIPTION OF THE DRAWING

Other advantages and objects of this invention will become apparent from the following description and accompanying drawing wherein.

BEST MODE OF CARRYING OUT THE INVENTION

Figure 1:
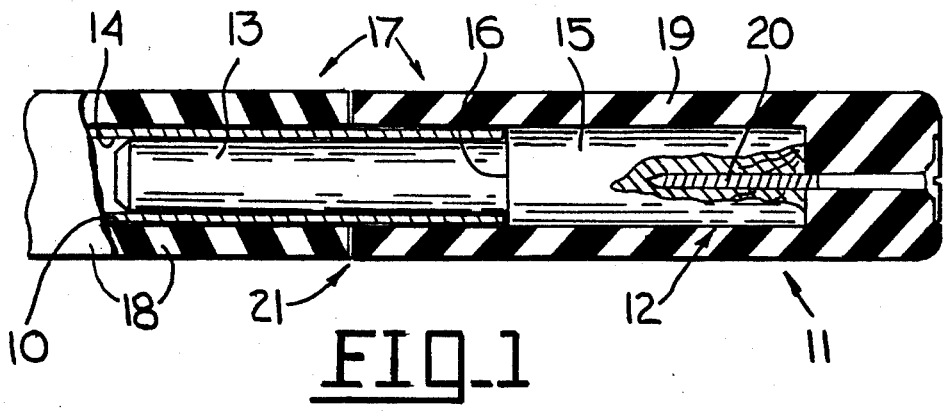
FIG. 1 is a partially sectioned side elevational view of a golf club shaft having an extender embodiment of this invention fixed on an end thereof.

FIG. 1 illustrates the grip end of a standard golf club shaft 10. The shaft is tubular and may be composed of any standard shaft material, such as stainless steel, aluminum, resin-impregnated graphite fibers or the like. This invention is directed to a replaceable extender 11, releasably attached to the end of the shaft to form a fixed extension thereof fully complying with the "Rules of Golf."

Figure 2:
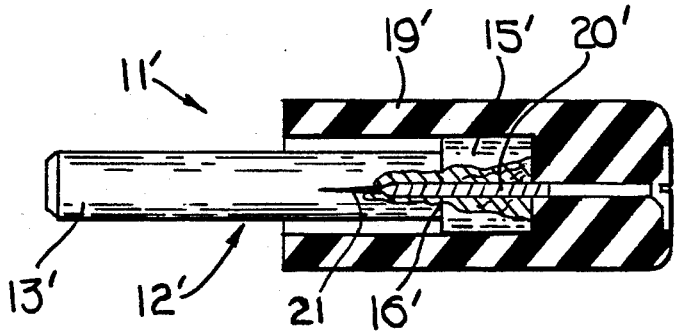
FIG. 2 is a similar view of a second extender, adapted to replace the extender of FIG. 1 to selectively change the fixed length of the shaft.

In the embodiment illustrated in FIGS. 1 and 2, "oversize" extenders 11 and 11' form a kit whereby the fixed length of shaft 10 can be selectively increased by 2.0 in. or 0.625 in. An extender kit embodiment generally of the type illustrated in FIGS. 1 and 2 and described below has been built and tested as an experimental prototype and was found to function efficiently for purposes intended. Identical numerals appearing in these figures depict corresponding parts and constructions. The drawings approximate actual sizes of such parts and constructions.

Referring once again to FIG. 1, extender 11 comprises an elongated and cylndrical plug 12 having a plug shaft 13 inserted in press-fit relationship into an internal bore 14 of shaft 11 and in co-axial alignment therewith. It has been found that when plug 12 is oomposed of a standard hardwood dowel material that the frictional fit between plug shaft 13 and bore 14 is sufficient to hold extender 11 on the end of shaft 10 without the use of additional securing means. Tapering of a standard golf club shaft downwardly towards the head end of the club may require a similar tapering of plug shaft 13 on a lathe or the like to provide frictional contact at least substantially throughout the length of plug shaft 13.

Plug 12 further comprises a plug mount 15 that has a diameter slightly larger than the diameter of plug shaft 13 to form an annular and radially extending shoulder 16 therebetween. As shown in FIG. 1, shoulder 16 abuts an end of shaft 10 to provide stop means for delimiting insertion of the plug shaft to precisely fix extender 11 longitudinally on shaft 10. Shoulder 16 preferablY has a radial depth closely approximating the wall thickness of shaft 10.

A composite grip 17 includes a first or shaft end portion 18 secured in a conventional manner on shaft 10 and a second or butt end portion 19 axially aligned with and abutting grip portion 18 to form a continuous and composite grip substantially identical to a standard one. If so desired, a piece of standard black plastic friction tape could be wrapped over a parting line 21 between grip portions 18 and 19. Grip portion 19 may be secured in enveloping relationship on plug mount 15 by a flat headed screw 20 or may be adhesively bonded thereto in a conventional manner.

As indicated above, extender 11 provides a golf club shaft that is shown as being over-sized by approximately 2.0 inches. When it is desired to lengthen the shaft to an oversized dimension of 0.625 in., for example, extender 11 is simply removed manually and replaced by extender 11' of FIG. 2. Extender 11' is constructed in a similar manner except for the shortened lengths of a plug mount 15' and a grip portion 19' the length of plug mounts 15 and 15' determining the added lengths to shaft 10. It should be noted in FIG. 1 that grip portion 19 overlaps and frictionally engages the extreme end of shaft 10 to aid plug shaft 13 in retaining extender 11 on the shaft.

Also, it should be noted that the axial lengths of the butt ends of grip portion 19 and 19' through which screws 20 and 20' extend are larger (0.937 in.) than normal (0.25 in.). Thus. the illustrated grip portions will add an additional "effective" length of 0.687 in. to the golf club shaft.

The method by which experimental prototypes, similar to extenders 11 and 11', were fabricated will now be described. A standard driver, having a graphite shaft of standard length, was utilized. The standard reinforced, elastomeric grip 17 was severed at parting line 21 to form grip portion 19' which was stripped-off shaft 10. The exposed end of the shaft was cleaned and the open extremity of the shaft at bore 14 was filed-down to define a slight chamfer to ready it for reception of plug shaft 13, which was formed with a slight taper or chamfer at its leading end.

Extender 11 was fabricated by first turning down plug 12 on a lathe to precisely dimension it in the manner described above. The plug constituted a piece of standard hardwood dowel. A new grip was then cut to provide grip portion 19 which was thereafter secured on plug mount 15 by screw 20. Plug shaft 13 was formed with a slight taper downwardly toward the head end of shaft 10, to provide a firm frictional gripping and bearing contact along the full length of the plug shaft within bore 14.

Thereafter, plug 12' was formed on a lathe and precisely dimensioned, substantially as shown but without shoulder 16', i.e., plug 12' solely constituted plug shaft 13. Grip portion 19' was then secured to the plug by screw 20' with the right end of plug shaft 13' internally abutting the butt end of grip portion 19'. It was found that when either extender 11 or 11' was attached to shaft 10 that the swing "feel" was substantially the same. Additional extenders of varied length (such as the FIG. 2 extender) could be made in accordance with the above method and teachings.

Pertinent dimensional parameters (in inches) of the above experimental prototype extenders were as follows:

| Dimension/Type | Extender 11 | Extender 11' |
|---|---|---|
| Overall Length | 4.25 | 3.0 |
| Length of Plug Shaft 13/13' | 2.25 | 2.75 |
| Length of Plug Mount 15/15' | 1.75 | |
| Radial Depth of Shoulder 16/16' | 0.0062 | |
| Diameter of Tapered Plug Shaft 13/13' | | |
| Leading End | 0.437 | 0.437 |
| Trailing End | 0.468 | 0.468 |
| Length of Grip Portion 19/19' | 2.875 | 1.000 |

The shaft of the golf club was a standard "graphite" shaft and the grips used were standard fabric reinforced elastomeric grips sold under the trademark "Golf Pride", pro only. The dimensions of each of the grips used approximated the following: length of 10.25 in.; tapered-down outside diameter of from 1.0 in. to 0.625 in.; tapered-down wall thickness of from 0.25 in. to 0.062 in; an inside diameter of 0.5 in.; and an axial wall thickness at the butt end of the club of 0.25 in. In one experiment, a thin coat of Devcon black rubber adhesive was applied to plug shaft 13 with good results; i.e., to aid in the frictional holding desiderata between shaft 10 and plug 12.

Figure 3:
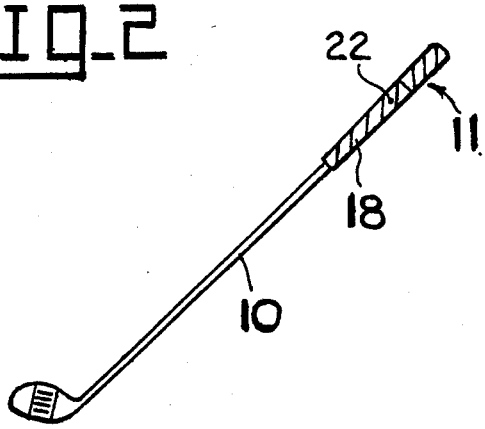
FIG. 3 illustrates a golf club having an extender of this invention attached thereto.

It should be understood that various modfications can be made to applicant's invention without departing from the spirit thereof. For example, the extreme left end of plug shafts 13 and 13' could be split centrally and longitudinally (e.g., two inches) and screws 20 and 20' could be lengthened to engage within a respective one of the splits to spread-out the split sides of the plug into a more positive locking relationship within bore 14 (e.g., split 21 in FIG. 2). Also, a lock pin or screw 22 (FIG. 3) could be inserted radially through grip portion 18, shaft 10 and plug shaft 13 to more securely lock plug 12 to shaft 10 and against relative axial movement therebetween. Further, the extreme end of shaft 10 could be threaded either internally or externally and grip portion 19 (by use of an internally threaded bushing inserted into the grip portion) or plug shaft 13 could be threaded on shaft 10 for selective axial movement thereon. In the latter application, disc-shaped elastomeric inserts, having inside and outside diameters corresponding to the size of grip 17 at parting line 21, could be mounted on shaft 10 to provide spacers to complete the continuity of the grip.

I claim:

1. A golf club comprising a tubular shaft having an internal bore defined therethrough, a first grip portion secured on and enveloping said shaft adjacent an end thereof and an extender simply, manually, removeably attached to the end of said shaft to form a fixed extension thereof, said extender comprising plug means inserted into said bore at the end of said shaft in co-axial alignment therewith, and a second grip portion secured to said plug means and aligned with said first grip portion and enveloping said end of said shaft to form a continuous extension thereof and a composite grip therewith.

2. The golf club of claim 1 wherein said plug means is in frictional engagement within said bore defined within said shaft.

3. The golf club of claim 1 wherein said plug means comprises an elongated plug shaft inserted into the end of said golf club shaft and a plug mount having said second grip portion secured in enveloping relationship thereon.

4. The golf culb of claim 3 further comprising stop means for delimiting insertion of said plug shaft into said golf club shaft.

5. The golf club of claim 4 wherein each of said plug and said plug mount are at least generally cylindrical with said plug mount having an outside diameter larger than the outside diameter of said plug shaft and said stop means comprises a radially extending annular shoulder formed on said plug means between said plug shaft and said plug mount.

6. The golf club of claim 5 wherein a skirt portion of said second grip portion extends beyond said shoulder in surrounding frictional engagement with said golf culb shaft and in axial abutment with an end of said first grip portion.

* * * * *